US008241068B2

(12) United States Patent
Millard et al.

(10) Patent No.: US 8,241,068 B2
(45) Date of Patent: Aug. 14, 2012

(54) PLUGGABLE CONNECTOR WITH DIFFERENTIAL PAIRS HAVING AN AIR CORE

(75) Inventors: Steven J. Millard, Mechanicsburg, PA (US); Megha Shanbhag, Palo Alto, CA (US); Steven Lee Flickinger, Hummelstown, PA (US); Brian Williams, York, PA (US); Kasthuri Sankar Damodhara, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 33 days.

(21) Appl. No.: 12/871,157

(22) Filed: Aug. 30, 2010

(65) Prior Publication Data

US 2012/0052738 A1 Mar. 1, 2012

(51) Int. Cl.
*H01R 24/00* (2011.01)
*H01R 33/00* (2006.01)

(52) U.S. Cl. ..... 439/660; 439/320

(58) Field of Classification Search ..... 439/660, 439/320, 321, 695, 359
See application file for complete search history.

(56) References Cited

U.S. PATENT DOCUMENTS

| | | | | |
|---|---|---|---|---|
| 5,766,040 | A * | 6/1998 | Naerland et al. | 439/607.08 |
| 6,077,122 | A | 6/2000 | Elkhatib et al. | |
| 6,116,965 | A | 9/2000 | Arnett et al. | |
| 6,280,229 | B1 * | 8/2001 | Harting et al. | 439/393 |
| 6,475,009 | B2 | 11/2002 | Below et al. | |
| 6,595,791 | B2 | 7/2003 | Below et al. | |
| 6,764,351 | B2 * | 7/2004 | Finzer et al. | 439/752 |
| 6,957,972 | B2 * | 10/2005 | Starke et al. | 439/320 |
| 7,074,066 | B2 | 7/2006 | Pepe | |
| 7,195,518 | B2 | 3/2007 | Bert et al. | |
| 7,207,807 | B2 * | 4/2007 | Fogg | 439/65 |
| 7,234,877 | B2 | 6/2007 | Sedor | |
| 7,275,961 | B2 | 10/2007 | Zauber et al. | |
| 7,303,418 | B2 | 12/2007 | O'Connor | |
| 7,316,584 | B2 * | 1/2008 | Mackillop et al. | 439/607.05 |
| 7,393,144 | B2 | 7/2008 | Khemakhem et al. | |
| 7,404,739 | B2 | 7/2008 | Sheilds et al. | |
| 7,422,484 | B2 | 9/2008 | Cohen et al. | |
| 7,540,789 | B2 | 6/2009 | Gerber | |
| 7,736,159 | B1 * | 6/2010 | Effinger et al. | 439/108 |
| 7,874,860 | B2 * | 1/2011 | Starke et al. | 439/320 |
| 7,938,650 | B2 | 5/2011 | Helmig | |
| 8,029,322 | B1 * | 10/2011 | Oh et al. | 439/695 |
| 2005/0118853 | A1 | 6/2005 | Starke | |
| 2005/0250365 | A1 | 11/2005 | Starke | |
| 2011/0294335 | A1 | 12/2011 | Sagdic | |
| 2012/0034809 | A1 | 2/2012 | Reimchen | |

OTHER PUBLICATIONS

M8 M12 Connector System for Tyco Electronics (May 2007).

* cited by examiner

*Primary Examiner* — Hae Moon Hyeon

(57) ABSTRACT

A pluggable connector that includes a connector housing having mating and loading ends and a longitudinal axis extending therebetween. The connector housing includes an insert cavity that opens to the mating end. The pluggable connector also includes a plug insert that is disposed within the insert cavity. The plug insert has an air core that extends in a direction along the longitudinal axis. The pluggable connector also including first and second differential pairs that extend along the longitudinal axis through the plug insert. Each of the first and second differential pairs includes two mating contacts that extend parallel to each other. The air core is located directly between the first and second differential pairs to control the electromagnetic coupling between the first and second differential pairs.

20 Claims, 5 Drawing Sheets

PLUGGABLE CONNECTOR WITH DIFFERENTIAL PAIRS HAVING AN AIR CORE

BACKGROUND OF THE INVENTION

The invention relates generally to electrical connectors, and more particularly to pluggable connectors that include differential pairs of mating contacts.

Electrical connectors used to plug a communication cable into an electrical system may include a housing that contains several conductors that form differential pairs. The differential pairs are configured to connect with corresponding differential pairs in a mating connector of the electrical system (e.g., a port) when the pluggable and mating connectors are engaged. However, pluggable connectors that are currently used may have certain limitations due to unwanted electromagnetic coupling between the differential pairs. For example, the operating speeds of M-series pluggable connectors are limited to transmission rates of less than one gigabit per second. If current M-series pluggable connectors were to operate at speeds above one gigabits/s or above five gigabits/s, the unwanted electromagnetic coupling between the differential pairs would harm signal integrity and the performance of the connector. For example, the increase in near-end crosstalk (NEXT), far-end crosstalk, and/or return loss may render the connector unable to meet industry requirements. Furthermore, it may be desirable to improve the insertion loss of such connectors.

Accordingly, there is a need for pluggable connectors that are configured to reduce the negative effects of electromagnetic coupling. There is also a need for pluggable connectors capable of operating at higher speeds and/or obtaining desired performances.

BRIEF DESCRIPTION OF THE INVENTION

In one embodiment, a pluggable connector is provided that includes a connector housing having mating and loading ends and a longitudinal axis extending therebetween. The connector housing includes an insert cavity that opens to the mating end. The pluggable connector also includes a plug insert that is disposed within the insert cavity. The plug insert has an air core that extends in a direction along the longitudinal axis. The pluggable connector also includes first and second differential pairs that extend along the longitudinal axis through the plug insert. Each of the first and second differential pairs includes two mating contacts that extend parallel to each other and in a direction along the longitudinal axis. The mating contacts are configured to engage corresponding contacts of a mating connector. The air core is located directly between the first and second differential pairs to control the electromagnetic coupling between the first and second differential pairs.

Optionally, the two mating contacts of each of the first and second differential pairs include proximal and distal mating contacts. The proximal mating contact is located closer to the air core than the distal mating contact. A line drawn between the proximal mating contacts of the first and second differential pairs intersects the air core. Also, the pluggable connector may also include at least four differential pairs that include the first and second differential pairs. In some embodiments, the differential pairs are located with respect to each other to effectively operate at a transmission speed of at least about ten gigabit/s.

In another embodiment, a pluggable connector is provided that includes a connector housing having mating and loading ends and a longitudinal axis extending therebetween. The connector housing includes an insert cavity that opens to the mating end. The pluggable connector also includes a plug insert that is disposed within the insert cavity. The plug insert has an air core that extends in a direction along the longitudinal axis. The pluggable connector also includes numerous differential pairs that are positioned with respect to one another in a contact arrangement. Each of the differential pairs includes two mating contacts that extend parallel to each other and in a direction along the longitudinal axis. The mating contacts are configured to engage corresponding contacts of a mating connector. The differential pairs are distributed about the air core such that the air core extends substantially through an array center of the contact arrangement.

DETAILED DESCRIPTION OF THE INVENTION

Embodiments described herein include pluggable connectors having mating contacts that form differential pairs. The differential pairs may be arranged to improve the performance of pluggable connectors with respect to other known connectors. For example, embodiments described herein have differential pairs arranged to control (e.g., reduce or improve upon) at least one of insertion loss, near-end crosstalk (NEXT), far-end crosstalk, and return loss. In particular embodiments, the differential pairs are arranged with respect to an air core that is sized and shaped to control electromagnetic coupling between or among the differential pairs.

A "pluggable connector." as described herein, is an electrical connector that is configured to mate with another electrical connector (also referred to as a mating connector) through a pluggable engagement. For example, pluggable connectors described herein include plug connectors that have a plug insert configured to be inserted into a cavity of a mating connector. The pluggable connectors may also be receptacle connectors having a cavity that receives a plug insert from a mating connector. Accordingly, a connector assembly of two pluggable connectors may include a first pluggable connector having a plug insert that is inserted into a cavity of a second pluggable connector. In some embodiments, the pluggable connectors may be sized and shaped to be handheld and freely movable by an operator or technician. However, in other embodiments, one or more of the pluggable connectors may be mounted to a support structure. For example, pluggable connectors described herein may be mounted to a circuit board.

When the pluggable connectors are engaged, the pluggable connectors may establish an environmental seal that protects transmissions through the pluggable connectors. In addition, the pluggable connectors may operate at high-speeds, such as at least one gigabit per second. In particular embodiments, the pluggable connectors are configured to transmit at multiple gigabits/s, such as at least about ten (10) gigabits/s.

The pluggable connectors described herein may be industrial-type connectors that form an environmental seal and are able to withstand harsh weather and vibration or shaking while maintaining a desired transmission rate or performance. Furthermore, the pluggable connectors may obtain desired performance levels while having a limited cross-sectional area where the differential pairs or conductors are arranged with respect to each other. For example, the pluggable connectors may be industrial type M-series connectors where a cross-section of the plug insert or insert cavity is substantially circular. A diameter of a cross-section of the plug insert may be less than about 23 millimeters or, more specifically, less than about 12 millimeters. In alternative embodiments, the pluggable connector has a greater diameter and/or is not substantially circular.

Figure 1:
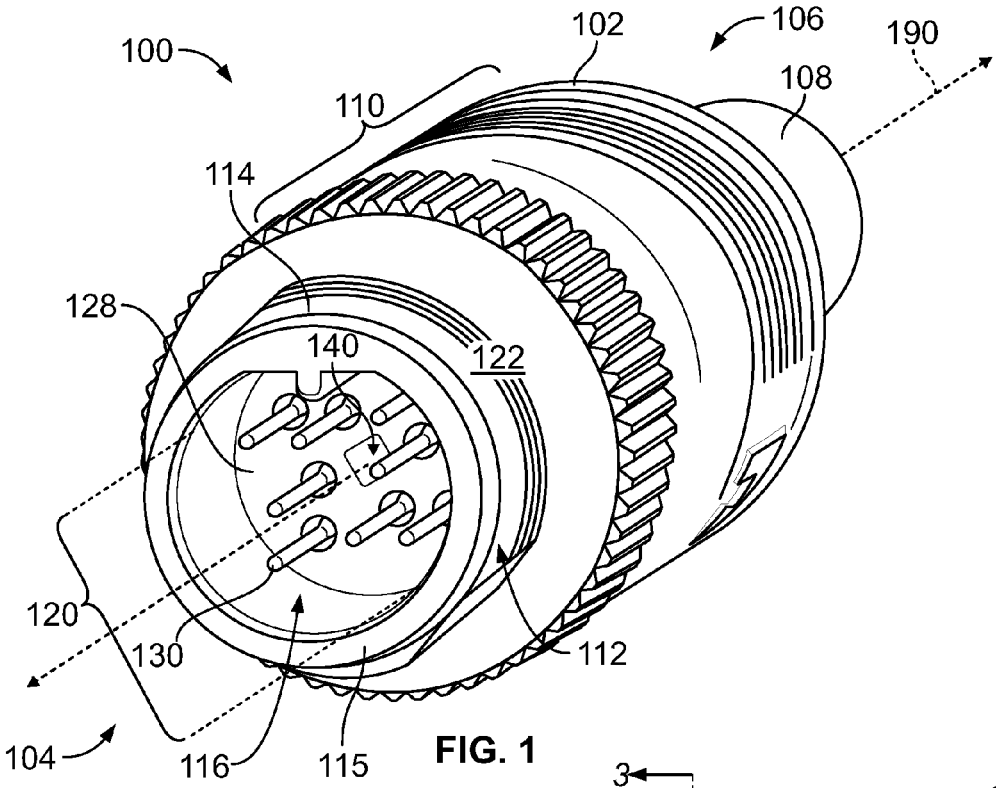
FIG. 1 is a perspective view of a pluggable connector formed in accordance with one embodiment.
Figure 2:
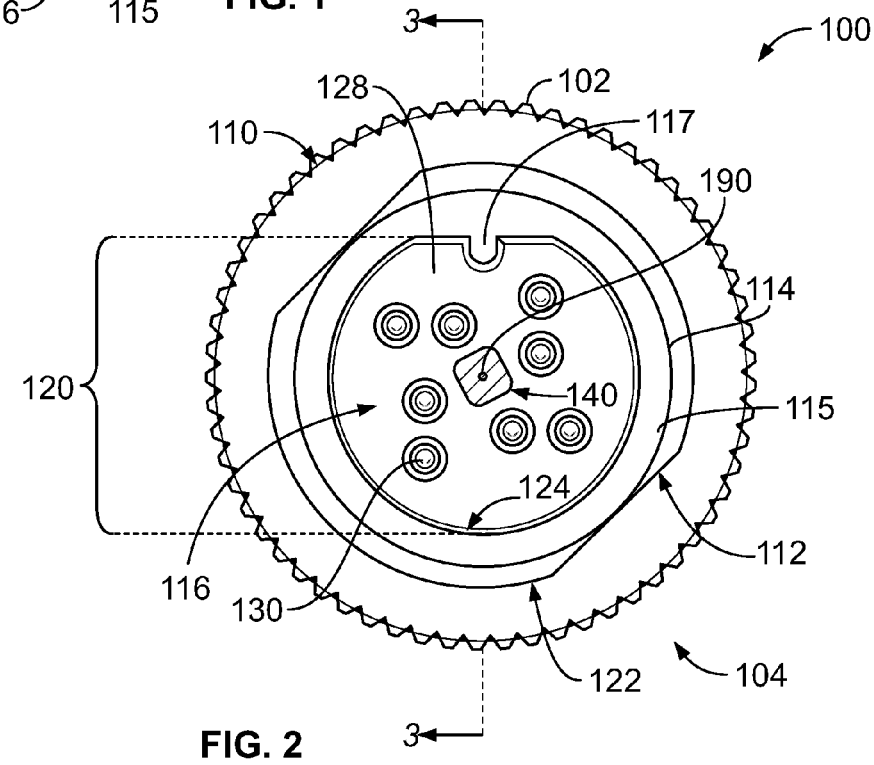
FIG. 2 is a plan view of a mating end of the pluggable connector shown in FIG. 1.

FIG. 1 illustrates a perspective view of a pluggable connector 100 formed in accordance with one embodiment, and FIG. 2 illustrates a plan view of a mating end 104 of the pluggable connector 100. The pluggable connector 100 may include a connector housing 102 having mating and loading ends 104 and 106 (FIG. 1) and a longitudinal axis 190 that extends therebetween. The mating end 104 is configured to engage a mating connector, such as the pluggable connector 200 shown in FIG. 4. In the illustrated embodiment, the loading end 106 is coupled to a communication cable 108 (FIG. 1) that permits the pluggable connector 100 to be freely moved by an operator or technician. However, in alternative embodiments, the pluggable connector 100 may be mounted to a support structure, such as a circuit board. The pluggable connector 100 may have a linear structure such that the entire connector housing 102 extends along the longitudinal axis 190. Alternatively, the entire connector housing 102 may not extend along the longitudinal axis 190, but may be shaped as desired. For example, the connector housing 102 may have a right-angle structure.

As shown, the connector housing 102 includes a base portion 110 that is connected to the cable 108 and an engagement portion 112 that includes the mating end 104. The engagement portion 112 includes a sidewall 114 that projects in a direction along the longitudinal axis 190 (also referred to as the longitudinal direction). The sidewall 114 also extends about or surrounds the longitudinal axis 190 to provide an insert cavity 116. The sidewall 114 includes a mating edge 115 that defines an opening 120 of the insert cavity 116. The opening 120 may be sized and shaped to receive a portion of the pluggable connector (or mating connector) 200.

The sidewall 114 may have a cross-section taken perpendicular to the longitudinal axis 190 that is sized and shaped to engage the pluggable connector 200. For example, the cross-section of the sidewall 114 may be substantially circular and include a keying feature 117. Furthermore, the insert cavity 116 may be sized and shaped to receive a plug insert 228 (shown in FIG. 4) from the pluggable connector 200. As shown, the sidewall 114 has an outer surface 122 and an inner surface 124 that defines the insert cavity 116. The outer surface 122 may be configured to removably couple to the mating connector. For example, the outer surface 122 may be threaded and configured to engage complementary threads on the inner surface of the pluggable connector 200. However, in alternative embodiments, the inner surface 124 may be threaded and be configured to engage complementary threads on an outer surface of the pluggable connector 200.

The insert cavity 116 is shaped to have a plug insert 128 of the pluggable connector 100 disposed therein. The plug insert 128 is configured to hold and space apart mating contacts 130 from each other. The plug insert 128 may comprise a dielectric material. The mating contacts 130 project from the plug insert 128 toward the opening 120 of the insert cavity 116 and in a direction that is parallel to the longitudinal axis 190. The mating contacts 130 may be arranged in a predetermined configuration so that the mating contacts 130 electrically connect with the mating contacts 230 (shown in FIG. 5) of the pluggable connector 200. As shown in FIGS. 1 and 2, the mating contacts 130 may be pin contacts. However, in other embodiments, the mating contacts 130 may be socket contacts that are configured to receive pin contacts.

Also shown in FIGS. 1 and 2, the plug insert 128 may include an air core 140 that extends in the direction along the longitudinal axis 190. The air core 140 extends through the dielectric material of the plug insert 128 and may be located to control unwanted electromagnetic coupling between the differential pairs. As shown in FIG. 2, in particular embodiments the air core 140 may extend through an approximate geometric center of the plug insert 128. The mating contacts 130 may be distributed about the air core 140 in a manner that reduces the unwanted effects of electromagnetic coupling.

The air core 140 may have a cross-section taken perpendicular to the longitudinal axis 190. A geometric shape of the cross-section may be configured to control the electromagnetic coupling between or among the differential pairs. For example, as shown, the air core 140 may have a substantially rectangular cross-sectional shape. More specifically, the cross-sectional shape of the air core 140 may be a rounded square. The air core 140 may have other cross-sectional shapes, such as triangular, pentagonal, or other polygonal shapes, as well as circular or elliptical shapes. Also, in the illustrated embodiment, the cross-sectional shape of the air core 140 may be uniform throughout the plug insert 128. Alternatively, the cross-sectional shape may vary as the air core 140 extends through the plug insert 128.

Figure 3:
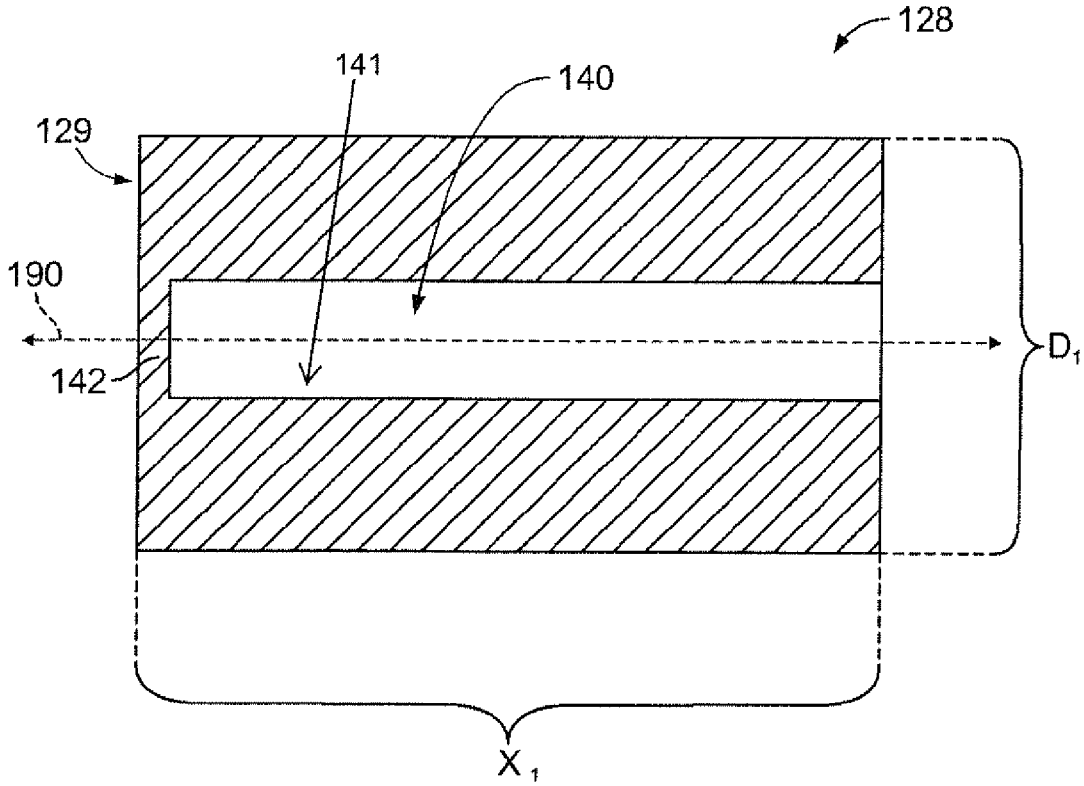
FIG. 3 is a cross-section of the pluggable connector in FIG. 1 illustrating an air core extending through a plug insert.

FIG. 3 is an isolated cross-section of the plug insert 128 taken along the lines 3-3 shown in FIG. 2. The plug insert 128 may have a length $X_1$ that extends between the mating and loading ends 104 and 106 of the pluggable connector 100 (FIG. 1) and a diameter $D_1$ that extends perpendicular to the longitudinal axis 190. As shown in FIGS. 2 and 3, the longitudinal axis 190 may also be characterized as a central axis because the longitudinal axis 190 may extend through a geometric center of the plug insert 128. The air core 140 may also extend through a geometric center of the plug insert 128. The mating contacts 130 (FIG. 1) may extend parallel to the longitudinal axis 190 for at least a portion of the plug insert 128 or the pluggable connector 100. In the illustrated embodiment, the air core 140 extends less than the entire length $X_1$ of the plug insert 128. For example, a mating face 129 of the plug insert 128 may include a covering or layer 142 of dielectric material. The covering 142 may separate the air core 140 from an exterior of the plug insert 128. In some embodiments, the plug insert 128 is formed from a molding-type process that results in the plug insert 128 having the covering 142. However, in alternative embodiments, the air core 140 may extend completely through the plug insert 128.

Also shown in FIG. 3, the plug insert 128 includes a dielectric material having an interior surface 141 that defines the air core 140 such that air in the air core 140 is in intimate contact with the interior surface 141 of the dielectric material during operation of the pluggable connector 100. In FIG. 3, the air core 140 does not include a conductive material in any portion of the air core 140.

Figure 4:
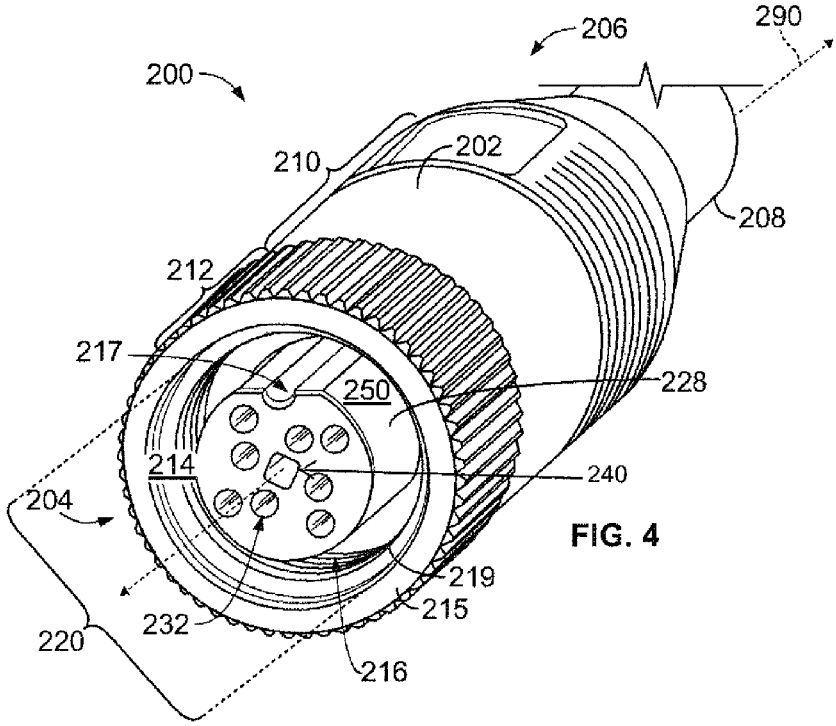
FIG. 4 is a perspective view of a pluggable connector formed in accordance with another embodiment that is configured to mate with the pluggable connector shown in FIG. 1.
Figure 5:
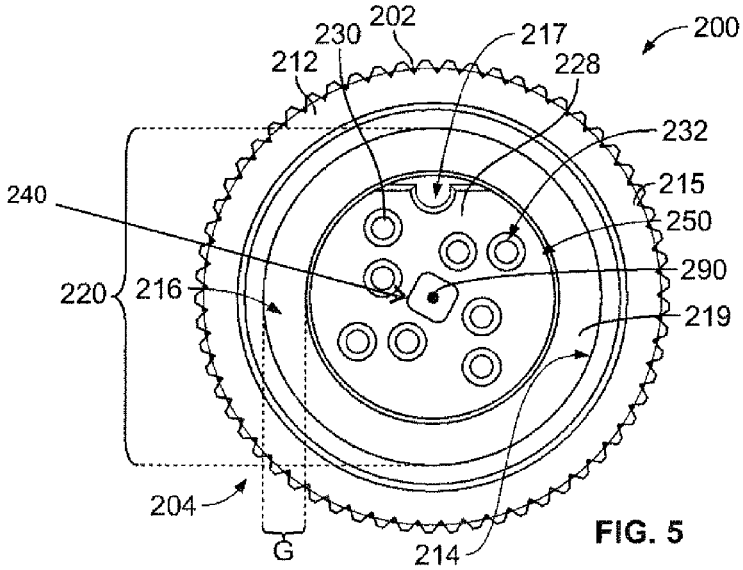
FIG. 5 is a plan view of a mating end of the pluggable connector shown in FIG. 4.

FIG. 4 illustrates a perspective view of a pluggable connector 200 formed in accordance with another embodiment, and FIG. 5 illustrates a plan view of a mating end 204 of the pluggable connector 200. The pluggable connectors 100 and 200 may have similar and complementary features for establishing an electrical connection during a mating operation. For example, the pluggable connector 200 may include a connector housing 202 having the mating end 204 and a loading end 206 (FIG. 4) and a longitudinal axis 290 that extends therebetween. The mating end 204 may be configured to engage the mating end 104 of the pluggable connector 100 shown in FIG. 1. The loading end 206 may be coupled to a communication cable 208 (FIG. 4) that permits the pluggable connector 200 to be freely moved by an operator or technician. The pluggable connector 200 may have a linear structure as shown in FIGS. 4 and 5 or may have other structures, such as a right-angle structure.

As shown, the connector housing 202 includes a base portion 210 (FIG. 4) that is connected to the cable 208 and a collar portion 212 that includes the mating end 204. The collar portion 212 includes an interior surface 214 that extends about or surrounds the longitudinal axis 290 to provide an insert cavity 216. The collar portion 212 includes a forward-facing edge 215 that defines an opening 220 of the insert cavity 216. The opening 220 may be sized and shaped to mate with the pluggable connector 100 (FIG. 1).

The insert cavity 216 is shaped to have the plug insert 228 of the pluggable connector 200 disposed therein. The plug insert 228 comprises a dielectric material and includes a plurality of contact cavities 232 that extend therethrough. In the illustrated embodiment, the contact cavities 232 have mating contacts 230 (FIG. 5) disposed therein that are configured to engage the mating contacts 130 (FIG. 1). The contact cavities 232 open toward the mating end 204. Also shown, the plug insert 228 may include an outer surface 250 that faces toward the interior surface 214 of the connector housing 202. The outer surface 250 and the interior surface 214 may be spaced apart by a gap G (FIG. 5). The gap G may be sized and shaped to receive the sidewall 114 (FIG. 1) of the pluggable connector 100.

In the illustrated embodiment, the mating contacts 230 are socket contacts and the mating contacts 130 are pin contacts that are received by the socket contacts. As such, the contact cavities 232 and corresponding mating contacts 230 are positioned with respect to the mating contacts 130 (FIG. 1) of the pluggable connector 100. The mating contacts 230 may have a contact arrangement that is a mirror image of the mating contacts 130. In alternative embodiments, the mating contacts 230 may be pin contacts and the mating contacts 130 may be socket contacts.

The plug insert may also include an air core 240 that extends therethrough. The air core 240 may have similar shapes and features as the air core 140 (FIG. 1). Also shown, the plug insert 228 may include a keying recess 217 that is sized and shape to receiving the keying feature 117 of the plug insert 128. When the pluggable connector 200 is fully engaged with the pluggable connector 100, the pluggable connector 200 and the pluggable connector 100 may form at least one of an environmental seal and an electrical shield. To this end, the pluggable connector 200 may include a sealing member 219 located a depth into the insert cavity 216. The sealing member 219 may comprise an elastic material.

To engage the pluggable connectors 100 and 200, the pluggable connectors 100 and 200 are aligned with each other such that the keying feature 117 of the sidewall 114 is aligned with the keying recess 217 of the plug insert 228. During a mating operation, the pluggable connectors 100 and 200 are moved toward each other in an axial direction. The sidewall 114 is advanced into the gap G of the insert cavity 216. The mating contacts 130 are received by the contact cavities 232 and engage the mating contacts 230 therein. When the sidewall 114 is fully inserted, the mating edge 115 (FIG. 1) may compress the sealing member 219. In the illustrated embodiment, the collar portion 212 may be rotated about the engagement portion 112 to form a removable engagement. However, other removable engagement mechanisms may be used in other embodiments.

Figure 6:
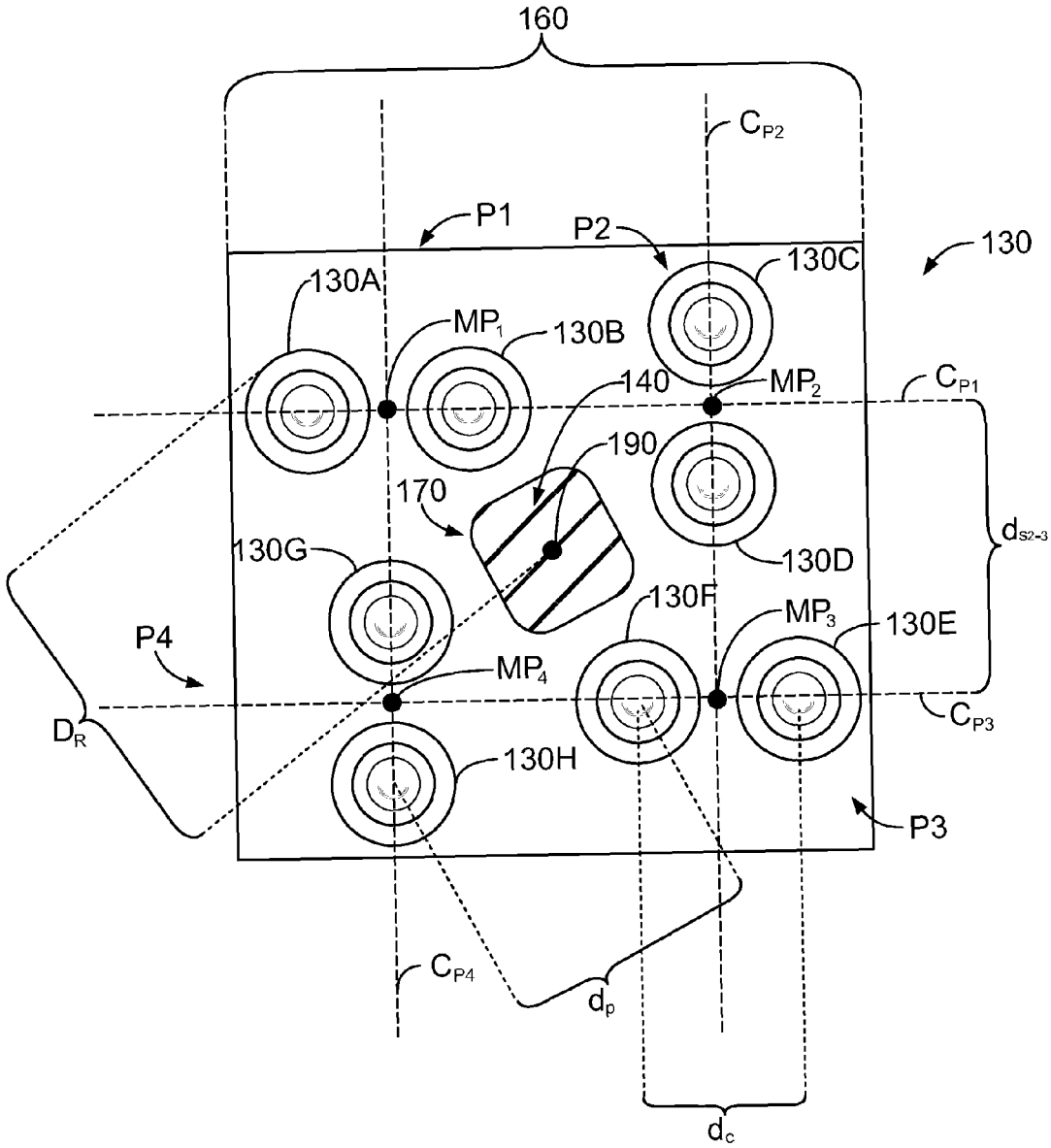
FIG. 6 shows an arrangement of mating contacts that may be used with the pluggable connector of FIG. 1.

FIG. 6 illustrates a contact arrangement (or contact array) 160 of the mating contacts 130 for the pluggable connector 100 (FIG. 1). The mating contacts 130 may extend parallel to one another and to the longitudinal axis 190. The mating contacts 130 may also extend parallel to the air core 140. Although the following is with specific reference to the mating contacts 130, the description may be similarly applied to the mating contacts 230 (FIG. 4) of the pluggable connector 200 (FIG. 4). However, the mating contacts 230 would be arranged in a mirror image of the mating contacts 130 so that the mating contacts 230 may receive the mating contacts 130 when the pluggable connectors 100 and 200 are engaged.

The differential pairs P1-P4 may be arranged with respect to each other in order to minimize unwanted electromagnetic coupling between or among the differential pairs P1-P4. The contact arrangement 160 may include numerous (e.g., more than two) differential pairs P positioned with respect to each other. For example, embodiments described herein may include at least lour differential pairs. In the illustrated embodiment, the contact arrangement 160 includes only four differential pairs P1-P4. Each of the differential pairs P1-P4 includes two mating contacts 130 that extend parallel to each other and the longitudinal axis 190. Although the pluggable connector 100 includes only four differential pairs P1-P4, in alternative embodiments, the pluggable connector 100 may include fewer differential pairs P (e.g., only two differential pairs) or may include more differential pairs P (e.g., six or eight differential pairs P).

The mating contacts 130 that form a corresponding differential pair P may be adjacent to one another. As used herein, two mating contacts are "adjacent" to one another when the two mating contacts do not have any other mating contact located directly between the two mating contacts, and the two mating contacts are relatively close to one another as compared to other mating contacts. In some embodiments, the adjacent mating contacts 130 that constitute a differential pair P are not closer to any mating contact 130 of another differential pair P. For example, the mating contacts 130A and 130B of the differential pair P1 are closest to each other, and there is no mating contact 130 from another differential pair P that is closer. Also shown, the two mating contacts 130 of each of the differential pairs P have a midpoint MP therebetween. At the corresponding midpoint MP, the mating contacts 130 of the differential pair P are equidistant from the corresponding midpoint MP.

The two mating contacts 130 of each of the differential pairs P may be separated from each other by a contact-separation distance $d_C$, and adjacent differential pairs P may be separated by a pair-separation distance $d_P$. The pair-separation distance $d_P$ is greater than the contact-separation distance $d_C$. In particular embodiments, the pair-separation distance $d_P$ is at least about 1.5 times greater than the contact-separation distance $d_C$. In more particular embodiments, the pair-separation distance $d_P$ is at least about two times greater than the contact-separation distance $d_C$.

As shown, the mating contacts 130A and 130B form the differential pair P1; the mating contacts 130C and 130D form the differential pair P2; the mating contacts 130E and 130F form the differential pair P3; and the mating contacts 130G and 130H form the differential pair P4. Although not specifically shown, each differential pair P has one mating contact having a positive polarity and another mating contact having a negative polarity. The two mating contacts 130 of one differential pair P transmit signals that are 180° out of phase with respect to each other. The two mating contacts 130 of each of the differential pairs P may include a proximal mating contact and a distal mating contact. The proximal mating contact is located closer to the air core 140 than the distal mating contact of the corresponding differential pair P. For example, the mating contacts 130B, 130D, 130F, and 130G are proximal mating contacts, and the mating contacts 130A, 130C, 130E, and 130H are distal mating contacts.

Also shown in FIG. 6, the two mating contacts 130 of each of the differential pairs P extend parallel to each other along a contact plane $C_P$ of the differential pair P. The differential pairs P1-P4 have the contact planes $C_{P1}$-$C_{P4}$, respectively, and are distributed about the air core 140. The air core 140 may extend substantially through an array center 170 of the contact arrangement 160. The array center 170 may be located in the geometric center of the plug insert 128 (FIG. 1). As shown, the array center 170 may be located within an area defined by the intersecting contact planes $C_{P1}$-$C_{P4}$. In particular embodiments, the differential pairs P1-P4 are evenly distributed about the air core 140 as shown in FIG. 6. For example, the proximal contacts 130B, 130D, 130F, and 130G are approximately equidistant from the air core 140.

In some embodiments, the contact planes $C_P$ of at least two adjacent differential pairs P are perpendicular to each other. The contact planes $C_P$ of the differential pairs that are located on opposite sides of the air core 140 may be parallel to each other. For example, the contact planes $C_{P1}$ and $C_{P3}$ of the differential pairs P1 and P3, respectively, extend parallel to each other, the contact planes $C_{P2}$ and $C_{P4}$ of the differential pairs P2 and P4, respectively, extend parallel to each other. Accordingly, in particular embodiments, the contact planes $C_P$ have one of two orientations such that the contact planes $C_P$ of the differential pairs P are oriented parallel to one another or perpendicular to one another. FIG. 6 shows a particular embodiment where each of the four differential pairs P1-P4 have a corresponding contact plane $C_P$ that extends perpendicular to the contact planes $C_P$ of two other differential pairs. For example, the contact plane $C_{P3}$ is perpendicular to the contact plane $C_{P2}$ and $C_{P4}$.

Also shown, the contact plane $C_P$ of a differential pair P may be positioned such that the contact plane $C_P$ bisects the distance $d_C$ separating the mating contacts 130 of an adjacent differential pair P (i.e., extends through the corresponding midpoint MP). For example, the contact plane $C_{P2}$ may bisect the distance $d_C$ that separates the mating contacts 130F and 130E. In alternative embodiments, the contact plane $C_P$ may be positioned such that the contact plane $C_P$ intersects a mating contact 130 of an adjacent differential pair P or intersects the contact plane $C_P$ of the adjacent differential pair P at a location that is not between the mating contacts 130. Furthermore, the contact plane $C_P$ of one differential pair P may intersect the contact plane $C_P$ of an adjacent differential pair P at a point between the mating contacts 130 of the adjacent differential pair P, but not at the midpoint MP.

The contact arrangement 160 may be configured to fit within a predetermined cross-sectional area. For example, the contact arrangement 160 of the mating contacts 130 may be located with respect to each other so that the mating contacts 130 are located within a predetermined radial distance $D_R$ from the longitudinal axis 190. The radial distance $D_R$ may be, for example, less than about 13 mm or less than about 6 mm. Moreover, the midpoints MP of each contact plane $C_P$ may be separated from each other by a distance $d_S$ so that the differential pairs P fit within a limited cross-sectional area while maintaining a desired performance. For example, the midpoint $MP_2$ and $MP_3$ may be separated from each other by a distance $d_{S2\text{-}3}$. The distances $d_S$ that separate the different midpoints MP may be substantially equal (i.e., not differing by more than 5%).

In other embodiments, the distances $d_S$ might not be substantially equal. For example, at least two of the distances $d_S$ may differ from each other by at least 10%. In such embodiments where at least two distances differ by at least 10%, the arrangement of differential pairs P may reduce the unwanted electromagnetic coupling between at least two differential pairs. Furthermore, such embodiments may improve at least one of NEXT, far-end crosstalk, insertion loss, and return loss.

Figure 7:
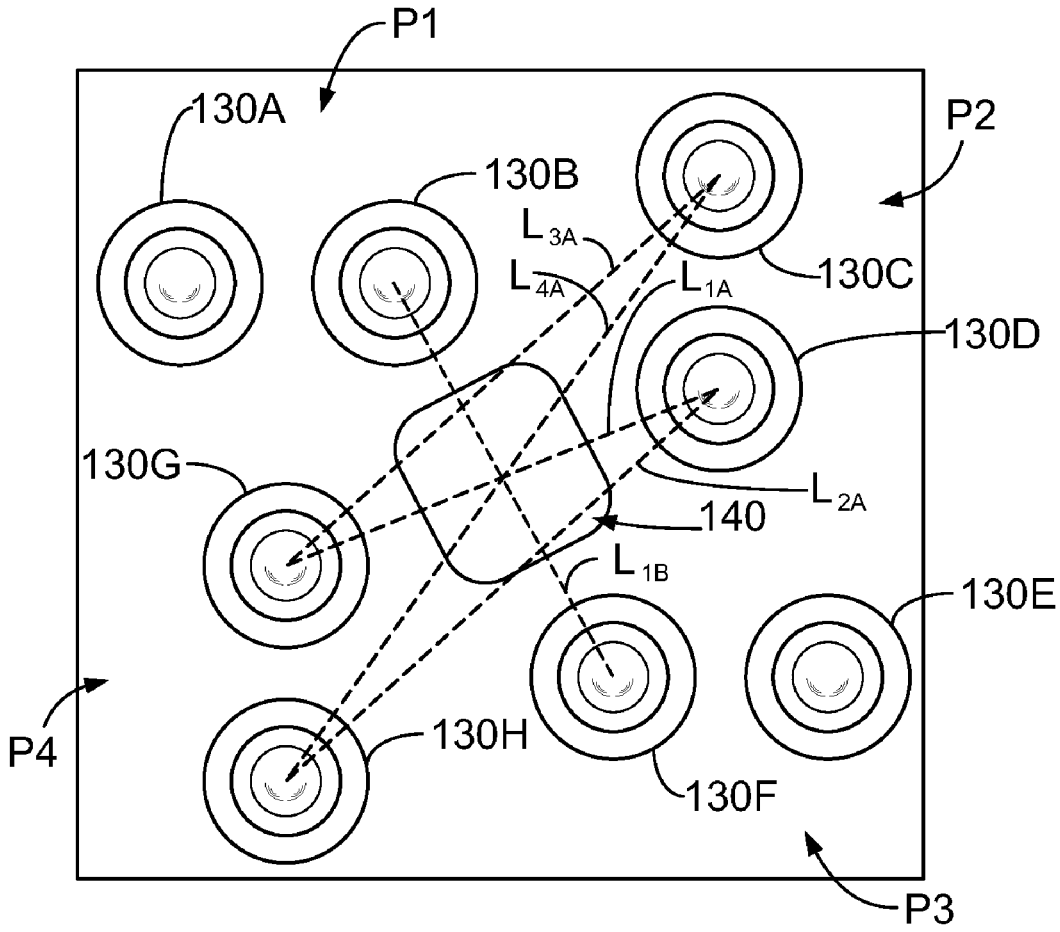
FIG. 7 illustrates a positional relationship between the mating contact and the air core.

FIG. 7 is the same view of the contact arrangement 160 shown in FIG. 6 and illustrates the positional relationship between the mating contacts 130 and the air core 140. As described above, the air core 140 may be located in the plug insert 128 (FIG. 1) with respect to the differential pairs P to control electromagnetic coupling between the differential pairs. For example, the air core 140 may be located directly between the differential pair P1 and the differential pair P3 in order to reduce the electromagnetic coupling between the differential pairs P1 and P3. Likewise, the air core 140 may be located directly between the differential pairs P2 and P4 to reduce the electromagnetic coupling therebetween.

For example, the air core 140 may be positioned directly between the differential pairs P2 and P4 such that a line LA drawn between the proximal mating contacts 130D and 130G of the differential pairs P2 and P4, respectively, intersects the air core 140. Likewise, the air core 140 may be positioned directly between the differential pairs P1 and P3 such that a line $L_{1B}$ drawn between the proximal mating contacts 130B and 130F of the differential pairs P1 and P3, respectively, intersects the air core 140. (As shown in FIG. 7, the lines $L_{1A}$ and $L_{1B}$ are drawn by extending the lines between the corresponding centers of the mating contacts 130.)

In particular embodiments, the differential pairs P and the air core 140 may be positioned relative to one another such that a line drawn from either of the two mating contacts of a corresponding differential pair P to either of the two mating contacts of a differential pair P that is located on the opposite side of the air core 140 intersects the air core 140. By way of example, a line may be drawn from each of the mating contacts 130C and 130D to either of the two mating contacts 130G and 130H that intersects the air core 140. As shown, the line $L_{1A}$ extends between the mating contacts 130D and 130G; a line $L_{2A}$ may extend between the mating contact 130D and the mating contact 130H; a line $L_{3A}$ may extend between the mating contact 130C and the mating contact 130G; and a line $L_{1A}$ may extend between the mating contact 130C and the mating contact 130H. Although not shown in FIG. 7, the mating contacts 130 of the differential pairs P1 and P3 may have similar positional relationships with respect to each other and the air core 140.

It is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first." "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A pluggable connector comprising:

a connector housing having mating and loading ends and a longitudinal axis extending therebetween, the connector housing including an insert cavity that opens to the mating end;

a plug insert disposed within the insert cavity, the plug insert having an air core extending in a direction along the longitudinal axis, the plug insert comprising a dielectric material having an interior surface that defines the air core such that air in the air core is in intimate contact with the interior surface of the dielectric material during operation of the pluggable connector; and first and second differential pairs extending through the plug insert, each of the first and second differential pairs comprising two mating contacts that extend parallel to each other and the longitudinal axis, the mating contacts configured to engage corresponding contacts of a mating connector, wherein the air core is located directly between the first and second differential pairs to control electromagnetic coupling between the first and second differential pairs.

2. The pluggable connector in accordance with claim 1 wherein said two mating contacts of each of the first and second differential pairs include proximal and distal mating contacts, the proximal mating contact being located closer to the air core than the distal mating contact, wherein a line drawn between the proximal mating contacts of the first and second differential pairs intersects the air core.

3. The pluggable connector in accordance with claim 1 wherein the first and second differential pairs are positioned relative to the air core such that a line drawn from either of the two mating contacts of the first differential pair to either of the two mating contacts of the second differential pair intersects the air core.

4. The pluggable connector in accordance with claim 1 wherein the air core extends through a geometric center of the plug insert.

5. The pluggable connector in accordance with claim 1 wherein said two mating contacts of each of the first and second differential pairs extends along a contact plane, the contact planes of the first and second differential pairs extending parallel to each other.

6. The pluggable connector in accordance with claim 1 comprising at least four differential pairs that include the first and second differential pairs.

7. The pluggable connector in accordance with claim 6 wherein the corresponding two mating contacts of each of the at least four differential pairs extends along a contact plane, the contact plane of each of the at least four differential pairs being oriented in one of two orientations such that the contact planes of the at least four differential pairs are oriented parallel to one another or perpendicular to one another.

8. The pluggable connector in accordance with claim 1 further comprising a third differential pair and a fourth differential pair, wherein the air core is located directly between the third and fourth differential pairs to control the electromagnetic coupling between the third and fourth differential pairs.

9. The pluggable connector in accordance with claim 1 wherein the plug insert has a mating face, the mating face including a dielectric material that covers the air core.

10. The pluggable connector in accordance with claim 1 wherein the mating contacts are one of pin contacts or socket contacts.

11. The pluggable connector in accordance with claim 1 wherein the differential pairs are located with respect to each other to effectively operate at a transmission speed of at least about ten gigabit/s.

12. The pluggable connector in accordance with claim 1 wherein the air core does not include a conductive material in any portion of the air core.

13. A pluggable connector comprising:

a connector housing having mating and loading ends and a longitudinal axis extending therebetween, the connector housing including an insert cavity that opens to the mating end;

a plug insert disposed within the insert cavity, the plug insert having an air core extending in a direction along the longitudinal axis, the plug insert comprising a dielectric material having an interior surface that defines the air core such that air in the air core is in intimate contact with the interior surface of the dielectric material during operation of the pluggable connector; and numerous differential pairs positioned with respect to one another in a contact arrangement, each of the differential pairs comprising two mating contacts that extend parallel to each other and the longitudinal axis, the mating contacts configured to engage corresponding contacts of a mating connector, wherein the differential pairs are distributed about the air core such that the air core extends substantially through an array center of the contact arrangement.

14. The pluggable connector in accordance with claim 13 wherein the air core extends through a geometric center of the plug insert.

15. The pluggable connector in accordance with claim 13 wherein the corresponding two mating contacts of each of the differential pairs extends along a contact plane, the contact plane of each of the differential pairs being oriented in one of two orientations such that the contact planes of the differential pairs are oriented parallel to one another or perpendicular to one another.

16. The pluggable connector in accordance with claim 13 wherein the differential pairs are evenly distributed about the air core.

17. The pluggable connector in accordance with claim 13 comprising at least four differential pairs.

18. The pluggable connector in accordance with claim 13 wherein the plug insert has a mating face, the mating face including a dielectric material that covers the air core.

19. The pluggable connector in accordance with claim 13 wherein the differential pairs are located with respect to one another to effectively operate at a transmission speed of at least about ten gigabit/s.

20. The pluggable connector in accordance with claim 13 wherein the air core does not include a conductive material in any portion of the air core.

* * * * *